US005476610A

United States Patent [19]

Schmid et al.

[11] Patent Number: 5,476,610

[45] Date of Patent: Dec. 19, 1995

[54] PROCESS FOR STABILIZING AQUEOUS ZEOLITE SUSPENSIONS

[75] Inventors: Karl-Heinz Schmid, Mettmann; Andreas Syldath, Duesseldorf; Ditmar Kischkel, Monheim, all of Germany

[73] Assignee: Henkel Kommanditgesellschaft auf Aktien, Duesseldorf, Germany

[21] Appl. No.: 369,831

[22] Filed: Jan. 6, 1995

Related U.S. Application Data

[63] Continuation of Ser. No. 182,011, Jan. 24, 1994, abandoned.

[30] Foreign Application Priority Data

Jul. 22, 1991 [DE] Germany ..... 41 24 247.5

[51] Int. Cl.[6] ..... C11D 3/12

[52] U.S. Cl. ..... 252/174.25; 252/135; 252/140; 252/174.17; 252/174.21; 252/540; 252/DIG. 1

[58] Field of Search ..... 252/135, 140, 252/174.17, 174.21, 174.25, 540, DIG. 1

[56] References Cited

U.S. PATENT DOCUMENTS

| | | | |
|---|---|---|---|
| 3,547,828 | 12/1970 | Mansfield et al. | 252/351 |
| 3,839,318 | 10/1974 | Mansfield | 260/210 R |
| 4,072,622 | 2/1978 | Kueling | 252/179 |
| 4,169,075 | 9/1979 | Kueling et al. | 252/558 |
| 4,179,393 | 12/1979 | Andree et al. | 252/140 |
| 4,264,480 | 4/1981 | Andree et al. | 252/140 |
| 4,529,541 | 7/1985 | Wilms et al. | 252/179 |
| 4,671,887 | 6/1987 | Diehl et al. | 252/526 |

FOREIGN PATENT DOCUMENTS

| | | |
|---|---|---|
| 0075995 | 4/1983 | European Pat. Off. . |
| 0487262 | 5/1992 | European Pat. Off. . |
| 2527388 | 4/1976 | Germany . |
| 3444311 | 12/1984 | Germany . |
| 3401861 | 3/1985 | Germany . |
| 3330220 | 3/1985 | Germany . |
| 3408040 | 9/1985 | Germany . |
| 3423351 | 1/1986 | Germany . |
| 3723826 | 1/1989 | Germany . |
| 57-061615 | 4/1982 | Japan . |
| 57-061616 | 4/1982 | Japan . |
| 8501039 | 3/1985 | WIPO . |
| 9114760 | 10/1991 | WIPO . |

OTHER PUBLICATIONS

Cosm. Chem. Spec, 52 (1987).

*Primary Examiner*—Hoa Van Le

*Attorney, Agent, or Firm*—Ernest G. Szoke; Wayne C. Jaeschke; Daniel S. Ortiz

[57] ABSTRACT

A process for stabilizing an aqueous zeolite suspension by adding to the suspension at least one nonionic surfactant comprising an alkyl or alkenyl glycoside of the formula $R^3O—(G)_x$ in which $R^3$ is an alkyl or alkenyl group containing 6 to 22 carbon atoms, G is a glycose residue of a sugar containing 5 or 6 carbon atoms and x is a number of 1 to 10. Only nonionic surfactants are added to the suspension to stabilize the suspension. The suspension may be stabilized by addition of the alkyl or alkenyl glycoside in combination with nonionic surfactant such as a Guebert alcohol polyethylene glycol ether or a fatty alcohol polyethylene glycol ether.

13 Claims, No Drawings

PROCESS FOR STABILIZING AQUEOUS ZEOLITE SUSPENSIONS

This application is a continuation of Ser. No. 08/182,011, filed Jan. 24, 1994, now abandoned.

FIELD OF THE INVENTION

This invention relates to a process for stabilizing aqueous zeolite suspensions by addition of selected nonionic surfactants.

1. Background of the Invention

Zeolites, particularly of the zeolite A type, are particularly important as builders in modern detergents and have largely replaced the polyphosphates used for decades. Their advantages lie not only in a high calcium binding capacity, but also and in particular in their high ecotoxicological compatibility [Tens. Surf. Det., 24, 322 (1987)].

In their production process, the zeolites are obtained in the form of aqueous suspensions which may either be stored and marketed as such or may be subjected to spray drying. Zeolites have extremely poor solubility in water, so that suspensions of zeolites readily sediment. In the most favorable case, this leads to phase separation although, normally, considerable quantities of the solid sink to the bottom of the vessels in storage, harden and have to be subsequently removed, size-reduced and resuspended which involves considerable effort. In other cases, the viscosity of the suspensions increases to such an extent that transfer to another vessel or circulation by pumping is difficult, if not impossible, and in any event involves considerable product losses.

There has been no shortage of attempts in the past to stabilize aqueous zeolite suspensions in such a way that they remain stable in storage for a sufficient time and can be transported through pipes without blocking them.

2. Related Art

For example, it is proposed in German patent application DE 33 20 220 A1 to add 0.5 to 5% by weight of a mixture of fatty alcohol ethoxylates and fatty alcohol sulfates or fatty alcohol ether sulfates to the suspensions.

German patent application DE 34 08 040 A1 describes a process for stabilizing 65% by weight zeolite A suspensions with 0.01 to 0.25% by weight of xanthan gum and carboxyfunctional or hydroxyfunctional polymers.

According to the teaching of German patent application DE 34 23 351 A1, zeolite suspensions can also be stabilized by the addition of polyglycol ethers, fatty alcohol ether sulfates, fatty acid alkanolamides or fatty acid monoglycerides at pH values of 9 to 10.

In addition, the use of many other stabilizers is known from the literature, including for example polycarboxylates with molecular weights above 1500, phosphonic acids, phosphoric acid esters, alkyl benzenesulfonates, layer silicates [DE-OS 27 388], alkylphenol polyglycol ethers [DE 34 01 861 A1, isotridecyl polyglycol ethers [DE 34 44 311 A1] and adducts of ethylene oxide with oxoalcohols [DE 37 19 042 A1].

However, the known processes have disadvantages in regard to adequate stabilization over a relatively wide temperature range, the quantities required and also the viscosity and residue-free flowout behavior of the suspensions.

Accordingly, the problem addressed by the present invention was to provide an improved process for stabilizing aqueous zeolite Suspensions which would not be attended by any of the disadvantages described above.

BRIEF DESCRIPTION OF THE INVENTION

The present invention relates to a process for stabilizing aqueous zeolite suspensions by addition of surfactants, characterized in that at least one nonionic surfactant selected from the group consisting of a) Guerbet alcohol polyethylene glycol ethers corresponding to formula (I):

$$R^1O-(CH_2CH_2O)_mH \quad (I)$$

in which $R^1$ is a branched alkyl radical containing 16 to 20 carbon atoms and m is a number of 3 to 15, b) fatty alcohol polyethylene glycol ethers corresponding to formula (II):

$$R^2O-(CH_2CH_2O)_nH \quad (II)$$

in which $R^2$ is an, aliphatic hydrocarbon radical containing 12 to 22 carbon atoms and 1, 2 or 3 double bonds and n is a number of 1 to 10, c) fatty alcohol polyglycol ethers corresponding to formula (III):

$$R^3O-(CH_2\overset{\overset{CH_3}{|}}{C}HO)_p(CH_2CH_2O)_qH \quad (III)$$

in which $R^3$ is an alkyl radical containing 6 to 10 carbon atoms, p is a number of 1 to 5 and q is a number of 3 to 15, and d) alkyl and/or alkenyl glycosides corresponding to formula (IV)

$$R^4O-(G)_x \quad (IV)$$

in which $R^4$ is an alkyl and/or alkenyl radical containing 6 to 22 carbon atoms, G is a glycose unit derived from a sugar containing 5 or 6 carbon atoms and x is a number of 1 to 10, is added to the suspensions.

It has surprisingly been found that the use of the selected nonionic surfactants or mixtures thereof with one another are capable of reliably stabilizing suspensions of zeolites over a broad temperature range, more particularly from 10° to 60° C. The suspensions also show high stability in storage over a prolonged period, can be transported through pipes and can readily be poured out with only minimal product losses.

DETAILED DESCRIPTION OF THE INVENTION

Zeolites are understood to be optionally water-containing alkali metal or alkaline earth metal alumosilicates corresponding to formula (V):

$$M_{2/z}O \cdot Al_2O_3 \cdot x\ SiO_2 \cdot yH_2O \quad (V)$$

in which M is an alkali metal or alkaline earth metal having a valency of z, x is a number of 1.8 to 12 and y is a number of 0 to 8 [Chem. i. u. Zt., 20, 117 (1986)].

Typical examples of zeolites of which aqueous dispersions may be stabilized by the process according to the invention are the naturally occurring minerals clinoptilolith, erionite or chabasite. However, synthetic zeolites, for example zeolite X $Na_{86}[(AlO_2)_{86}(SiO_2)_{106}].264\ H_2O$ zeolite Y $Na_{56}[(AlO_2)_{56}(SiO_2)_{136}].325\ H_2O$ zeolite $K_9[(AlO_2)_g(SiO_2)_{27}]\cdot 22\ H_2O$ mordenite $Na_{8.7}[(AlO_2)_{8.7}(SiO_2)_{39.3}].24\ H_2O$, are preferred, zeolite A $Na_{12}[(AlO)_2)_{12}(SiO_2)_{12}].27\ H_2O$ being particularly preferred.

The aqueous suspensions may contain the zeolites in quantities of 20 to 60% by weight and preferably in quantities of 25 to 50% by weight.

Adducts of ethylene oxide and/or propylene oxide with Guerbet or fatty alcohols are known nonionic surfactants which may be produced on an industrial scale by the process known per se of alkoxylation.

Guerbet alcohol polyethylene glycol ethers (group a) which may be used in the process according to the invention are adducts of on average 3 to 15 moles of ethylene oxide with 1 mole of a branched primary alcohol of the Guerbet type; particulars of the structure and production of the Guerbet alcohols can be found in Soap, Cosm. Chem. Spec., 52 (1987). Typical examples of Guerbet alcohol polyethylene glycol ethers which may be used in accordance with the invention are adducts of 3 to 15 moles of ethylene oxide with 2-hexyl decanol or 2-octyl dodecanol. Compounds of formula (I), in which $R^1$ is a branched alkyl radical containing 16 or 20 carbon atoms and m is a number of 3 to 10, are preferred.

Fatty alcohol polyethylene glycol ethers which form group b) are adducts of on average 1 to 10 moles of ethylene oxide with technical fatty alcohols containing 12 to 22 carbon atoms and 1, 2 or 3 double bonds. Typical examples are ethylene oxide adducts of palmitoleyl alcohol, oleyl alcohol, elaidyl alcohol, petroselinyl alcohol, linolyl alcohol, linolenyl alcohol, gadoleyl alcohol or erucyl alcohol. Fatty alcohol polyglycol ethers of formula (II), in which $R^2$ is a $C_{12-18}$ alkenyl radical and n is a number of 4 to 9 and, more particularly, a number of 4 to 5, are preferred. The fatty alcohol polyethylene glycol ethers may have both a conventional homolog distribution and a narrow-range homolog distribution.

In addition, fatty alcohol polyethylene glycol ethers derived from technical cuts rather than from the pure alcohols, such as are obtained for example in the selective hydrogenation of fatty acid methyl ester fractions based on vegetable or animal raw materials, may also be used. The technical cuts may also contain saturated fatty alcohols with C numbers in the range mentioned above providing the iodine value of the fatty alcohol fraction used is at least 10. Fatty alcohol polyethylene glycol ethers based on fatty alcohols having an iodine value of 10 to 125 and, more particularly, 55 to 110 are preferably used. Examples of such fatty alcohol polyethylene glycol ethers are those based on peanut oil, cottonseed oil, coriander oil, soybean oil, beef tallow, rapeseed oil (oleic acid content >80% by weight), sunflower oil (oleic acid content >80% by weight) and, in particular, coconut oil. An adduct of 6 to 8 moles of ethylene oxide with a technical oleyl alcohol based on coconut oil alcohol with an iodine value of 10 to 20 is particularly preferred.

Fatty alcohol polyglycol ethers (group c) are adducts of on average 1 to 5 moles of propylene oxide and 3 to 15 moles of ethylene oxide with fatty alcohols containing 8 to 10 carbon atoms. The addition of propylene oxide and ethylene oxide may be carried out statistically (random distribution). However, the products are preferably obtained by initially reacting the fatty alcohols with propylene oxide in the presence of typical alkoxylation catalysts, for example sodium methylate or hydrotalcite, optionally freeing the propoxylate from low-boiling impurities by distillation and then reacting it with ethylene oxide (block distribution). It is preferred to use fatty alcohol polyglycol ethers corresponding to formula (III) in which $R^3$ is an octyl radical, p has a value of 1 and q has a value of 1 to 10.

The alkyl and/or alkenyl glycosides (group d) used in accordance with the invention are also known substances. Processes for the production start out, for example, from glucose or starch which are reacted with alcohols either directly or via the intermediate stage of butyl glycosides [U.S. Pat. No. 3,547,828, U.S. Pat. No. 3,839,318, DE-A 37 23 826].

The alkyl radical R* in formula (IV) may be derived from primary saturated or monounsaturated alcohols containing 6 to 22 and preferably 12 to 18 carbon atoms. Typical examples are caproic alcohol, caprylic alcohol, capric alcohol, lauryl alcohol, myristyl alcohol, cetyl alcohol, palmitoleyl alcohol, stearyl alcohol, elaidyl alcohol, oleyl alcohol, petroselinyl alcohol, behenyl alcohol or erucyl alcohol and technical mixtures thereof.

Alkyl or alkenyl glycosides corresponding to formula (IV), which are particularly suitable for stabilizing aqueous zeolite suspensions, may be derived from aldoses or ketoses. The glycosides of reducing saccharides, more particularly glucose, are particularly suitable by virtue of their greater reactivity and their ready availability. Accordingly, the alkyl and/or alkenyl glycosides preferably used are alkyl and/or alkenyl glucosides.

The index x in formula (IV) indicates the degree of oligomerization, i.e. the distribution of mono- and oligoglycosides, and is a number of 1 to 10. Whereas x in a given compound must always be an integer and, above all, may assume a value of 1 to 6, the value x for a certain alkyl or alkenyl glycoside is an analytically determined calculated quantity which is generally a broken number. Alkyl and/or alkenyl glycosides having an average degree of oligomerization x of 1 to 3 are preferably used. Alkyl and/or alkenyl glycosides having a degree of oligomerization x below 1.5 and, more particularly, between 1.1 and 1.4 are particularly preferred.

Particularly stable zeolite suspensions are obtained where alkyl glycosides corresponding to formula (IV), in which $R^4$ is a linear $C_{12-18}$ alkyl radical, G is a glucose unit and x is a number of 1 to 3, are used as stabilizers.

The stabilizers of groups a) to d) may be used individually or in admixture. Several stabilizers belonging to groups a) and d) may also be combined with one another. For example, mixtures of adducts of on average 7 to 9 moles of ethylene oxide with technical oleyl alcohol in a ratio by weight of 20:80 to 80:20 have proved to be particularly effective. Another preferred embodiment of the invention is characterized by the use of a mixture containing p1 i) 10 to 25% by weight of a fatty alcohol polyethylene glycol ether corresponding to formula (II), in which $R^2$ is a $C_{12-19}$ alkenyl radical and n is a number of 5 to 10, and ii) 75 to 90% by weight of an alkyl glycoside corresponding to formula (IV), in which R4 is a $C_{12-18}$ alkyl radical, G is a glucose unit and x is a number of 1.1 to 1.4.

Mixtures of this type are formed as an intermediate stage, for example in the production of alkyl glucosides, and may be directly used without further purification for the stabilization of aqueous zeolite suspensions [DE 36 03 581 A1].

The introduction of the stabilizers into the suspension is not critical and may be carried out, for example, mechanically by stirring in, optionally at elevated temperatures of 50° C. No chemical reaction takes place. The nonionic surfactants may be added to the suspensions in quantities of 0.1 to 5% by weight and preferably in quantities of 1 to 3% by weight, based on the suspension.

The following Examples are intended to illustrate the invention without limiting it in any way.

EXAMPLES

An aqueous suspension of zeolite A (Sasil®, solids content: 49.6% by weight, free alkali content: 0.32% by weight, a product of Henkel KGaA) was introduced into a 500 ml glass beaker and quantities of 1.5% by weight, based on the suspension, of the stabilizers or stabilizer mixtures—expressed as solids—were then added.

Stabilizers used—Examples according to the invention (30% weight aqueous pastes):

A Adduct of on average 1 mole of propylene oxide and 3 moles of ethylene oxide with octanol B Adduct of on average 7.2 moles of ethylene oxide with a technical oleyl alcohol based on rapeseed oil (iodine value=108)

C Adduct of on average 9 moles of ethylene oxide with a technical oleyl alcohol based on rapeseed oil (iodine value=108)

D Adduct of on average 3 moles of ethylene oxide with a $C_{16}$ Guerbet alcohol $C_{12/14}$ alkyl glucoside based on hydrogenated coconut oil alcohol; degree of oligomerization x=1.3

Stabilizers used—Comparison Examples (30% by weight aqueous pastes):

G Adduct of on average 5 moles of ethylene oxide with isotridecyl alcohol

H Adduct of on average 7 moles of ethylene oxide with isotridecyl alcohol

I Adduct of on average 9 moles of ethylene oxide with isotridecyl alcohol

J Adduct of on average 7 moles of ethylene oxide with technical $C_{12/18}$ coconut oil fatty alcohol (iodine value <0.3)

The stability of the suspensions was evaluated over a period of 1 to 6 days on the basis of the following criteria:

1) Sedimentation (Sd):
The height of the liquid phase above the suspension was measured in mm.

2) Sediment (Smt.):
1=slight sediment, no hardening
2=slight sediment, slight hardening
3=slight sediment, serious hardening
4=thick sediment, no hardening
5=thick sediment, slight hardening
6=thick sediment, serious hardening 3) Viscosity (Vis):
I=thinly liquid to VI=pasty, viscous 4) Flowout (F):
Residue in a glass beaker after decantation; expressed in % by weight, based on the suspension.

The results are set out in Tables 1 and 2. Examples 1 to 11 correspond to the invention while Examples C1 to C4 are Comparison Examples. All percentages are by weight.

TABLE 1

Stabilization of zeolite A suspensions

| Ex. | S1 | S2 | Ratio | cS % | T °C. | t d | Sd mm | Smt. | Vis. | F % |
|---|---|---|---|---|---|---|---|---|---|---|
| 1 | A | — | — | 1.5 | 20 | 1 | — | 1 | IV | |
| | | | | | 20 | 6 | — | 1 | IV | 8 |
| | | | | | 50 | 6 | 2 | 3 | II | |
| 2 | B | — | — | 1.5 | 20 | 1 | — | 1 | IV | |
| | | | | | 20 | 2 | — | 1 | IV | |
| | | | | | 20 | 3 | — | 1 | IV | |
| | | | | | 20 | 6 | — | 1 | IV | 13 |

TABLE 1-continued

Stabilization of zeolite A suspensions

| Ex. | S1 | S2 | Ratio | cS % | T °C. | t d | Sd mm | Smt. | Vis. | F % |
|---|---|---|---|---|---|---|---|---|---|---|
| | | | | | 50 | 6 | 3 | 4 | II | |
| 3 | B | C | 80:20 | 1.5 | 20 | 1 | — | 1 | IV | |
| | | | | | 20 | 2 | — | 1 | IV | |
| | | | | | 20 | 3 | — | 1 | IV | |
| | | | | | 20 | 6 | 1 | 1 | IV | 15 |
| | | | | | 50 | 6 | 2 | 2 | III | |
| 4 | B | C | 70:30 | 1.5 | 20 | 1 | — | 1 | IV | |
| | | | | | 20 | 2 | — | 1 | IV | |
| | | | | | 20 | 3 | — | 1 | III | |
| | | | | | 20 | 6 | — | 1 | III | 10 |
| | | | | | 50 | 6 | 2 | 1 | II | |
| 5 | B | C | 50:50 | 1.5 | 20 | 1 | — | 2 | IV | |
| | | | | | 20 | 2 | — | 1 | III | |
| | | | | | 20 | 3 | — | 1 | III | |
| | | | | | 20 | 6 | 2 | 1 | III | 11 |
| | | | | | 50 | 6 | 1 | 2 | II | |
| 6 | B | C | 30:70 | 1.5 | 20 | 1 | — | 2 | IV | |
| | | | | | 20 | 2 | 2 | 2 | III | |
| | | | | | 20 | 3 | 3 | 2 | III | |
| | | | | | 20 | 6 | 4 | 3 | III | 15 |
| | | | | | 50 | 6 | — | 1 | III | |
| 7 | B | C | 20:80 | 1.5 | 20 | 1 | — | 2 | IV | |
| | | | | | 20 | 2 | 2 | 2 | III | |
| | | | | | 20 | 3 | 4 | 2 | III | |
| | | | | | 20 | 6 | 5 | 3 | III | 16 |
| | | | | | 50 | 6 | — | 1 | IV | |
| 8 | B | E | 20:80 | 1.5 | 20 | 1 | — | 1 | III | |
| | | | | | 20 | 6 | 2 | 2 | III | |
| | | | | | 50 | 6 | — | 1 | III | |
| 9 | C | — | — | 1.5 | 20 | 1 | — | 2 | IV | |
| | | | | | 20 | 2 | 1 | 2 | III | |
| | | | | | 20 | 3 | 3 | 2 | III | |
| | | | | | 20 | 6 | 3 | 2 | II | 8 |
| | | | | | 50 | 6 | — | 1 | IV | |
| 10 | D | — | — | 1.5 | 20 | 1 | — | 1 | IV | |
| | | | | | 20 | 6 | 3 | 2 | III | |
| | | | | | 50 | 6 | — | 1 | IV | |
| 11 | E | — | — | 1.5 | 20 | 1 | — | 1 | IV | |
| | | | | | 20 | 2 | — | 1 | IV | |
| | | | | | 20 | 3 | — | 1 | IV | |
| | | | | | 20 | 6 | — | 1 | IV | 18 |
| | | | | | 50 | 6 | — | 1 | III | |

TABLE 2

Stabilization of zeolite A suspensions (comparison tests)

| Ex. | S1 | S2 | Ratio | cS % | T °C. | t d | Sd mm | Smt. | Vis. | F % |
|---|---|---|---|---|---|---|---|---|---|---|
| C1 | F | — | — | 1.5 | 20 | 1 | 8 | 6 | VI | |
| | | | | | 20 | 2 | 8 | 6 | VI | |
| | | | | | 20 | 3 | 10 | 6 | VI | |
| | | | | | 20 | 6 | 13 | 6 | VI | |
| | | | | | 50 | 6 | 8 | 6 | VI | |
| C2 | G | — | — | 1.5 | 20 | 6 | 2 | 2 | III | 11 |
| | | | | | 50 | 6 | 8 | 6 | VI | |
| C3 | H | — | — | 1.5 | 20 | 6 | 8 | 6 | VI | 19 |
| | | | | | 50 | 6 | 3 | 3 | II | |
| C4 | I | — | — | 1.5 | 20 | 6 | 8 | 6 | IV | |
| | | | | | 50 | 6 | 3 | 3 | II | |

Legend: S = Stabilizer (nonionic surfactant)
Ratio = Ratio by weight of the stabilizers used
cS = Concentration of the stabilizers used

We claim:

1. A process for stabilizing an aqueous zeolite suspension by addition of surfactants which comprises: adding to the suspension at least one nonionic surfactants comprising an alkyl or alkenyl glycoside of the formula $$R^3O\text{-}(G)_x \quad \text{(III)}$$

in which $R^3$ is an alkyl or alkenyl group containing 6 to 22 carbon atoms, G is a residue of a sugar containing 5 or 6 carbon atoms and x is a number of 1 to 10, wherein only nonionic surfactant is added to the suspension to stabilize the suspension.

2. The process of claim 1, wherein the nonionic surfactant is added to an aqueous suspension of zeolite A which has a solids content of 20 to 60% by weight.

3. The process of claims wherein the nonionic surfactant comprises a mixture of the glycoside and a Guerbet alcohol polyethylene glycol ether of the formula $R^1O—(CH_2CH_2O)_mH$ (I), in which $R^1$ is a branched $C_{16}$ to $C_{20}$ alkyl group and m is a number of 3 to 10.

4. The process of claim 1 wherein the nonionic surfactant comprises a mixture of the glycoside and a fatty alcohol polyglycol ether of the formula $$R^2O—(CH_2\overset{CH_3}{\overset{|}{C}}HO)_p(CH_2CH_2O)_qH \quad \text{(II)}$$

in which $R^2$ is an octyl group, p has a value of 1 and q has a value of 1 to 10.

5. The process of claim 1 wherein the nonionic surfactant comprises an alkyl glycoside of the formula (III), in which $R^3$ is a linear $C_{12\text{-}18}$ alkyl group, G is a glucose residue and x is a number of 1 to 3.

6. The process of claim 1 wherein the nonionic surfactant is added to the suspension in an amount of from 0.1 to 5% by weight of the suspension.

7. The process of claim 1 wherein the surfactant comprises the glycoside and at least one surfactant selected from the group consisting of a) Guerbet alcohol polyethylene glycol ethers of the formula:

$$R^1O—(CH_2CH_2O)_mH \quad \text{(I)},$$

and b) fatty alcohol polyethylene glycol ethers of the formula:

$$R^2O—(CH_2\overset{CH_3}{\overset{|}{C}}HO)_p(CH_2CH_2O)_qH \quad \text{(II)}$$

wherein $R^1$ is a branched alkyl group containing 6 to 20 carbon atoms and m is a number of 3 to 15, $R^2$ is an alkyl group contianing 6 to 10 carbon atoms, p is a number of 1 to 5 and q is a number of 3 to 15.

8. The process of claim 6 wherein the nonionic surfactant is added to the suspension in an amount of from 0.1% to 3.0% by weight of the suspension.

9. The process of claim 1 wherein the nonionic surfactant comprises an alkyl glycoside of the formula (III) wherein the value of X is less than 1.5.

10. The process of claim 9 wherein the value of X is from 1.1 to 1.4.

11. The process of claim 1 wherein G is a glucose residue.

12. The process of claim 11 wherein the value of X is less than 1.5.

13. The process of claim 12 wherein the value of X is from 1.1 to 1.4.

* * * * *